US005577457A

United States Patent [19]

Nichols, Jr.

[11] Patent Number: 5,577,457

[45] Date of Patent: Nov. 26, 1996

[54] POSITIONING AND LIFTING DEVICE FOR A WATERCRAFT

[76] Inventor: John B. Nichols, Jr., 835 Memorial Dr., Winthrop, Me. 04364

[21] Appl. No.: 374,061

[22] Filed: Jan. 18, 1995

[51] Int. Cl.[6] ..... B63B 35/71; B63B 17/00

[52] U.S. Cl. ..... 114/343; 114/347; 114/364; 224/266

[58] Field of Search ..... 114/347, 343, 114/364, 361; 224/101, 182, 267, 271, 265, 266

[56] References Cited

U.S. PATENT DOCUMENTS

| | | | |
|---|---|---|---|
| 2,970,846 | 2/1961 | Boston | 280/40 |
| 3,093,386 | 6/1963 | Case | 280/42 |
| 3,377,095 | 4/1968 | Allen | 294/19 |
| 3,445,018 | 5/1969 | Reagan | 214/450 |
| 3,570,730 | 3/1971 | Stevens | 224/42.11 |
| 3,734,367 | 5/1973 | Jackson | 224/25 A |
| 4,016,615 | 4/1977 | Main | 224/25 A |
| 4,236,267 | 12/1980 | Lewis | 403/391 |
| 4,538,829 | 9/1985 | Horowitz | 280/641 |
| 4,641,874 | 2/1987 | Grenzer | 294/15 |
| 4,768,459 | 9/1988 | Cerkvenik | 114/363 |
| 4,804,123 | 2/1989 | French | 224/266 |
| 4,838,195 | 6/1989 | Carter | 114/343 |
| 4,862,818 | 9/1989 | Sullivan | 114/347 |
| 5,127,356 | 7/1992 | Schenkenberger | 114/347 |

FOREIGN PATENT DOCUMENTS

| | | | |
|---|---|---|---|
| 1105751 | 3/1968 | United Kingdom | 114/361 |

OTHER PUBLICATIONS

Angier, B. & Taylor, Z., *Introduction to Canoeing*. Stackpole Books, Harrisburg, PA, 1973.

Bearce, R., *The Canoe Camping Handbook*. Winchester Press, New York, 1974.

Davidson, J. & Rugge, J., *The Complete Wilderness Paddler*. Knoff/Random House, New York, 1976.

Handel & Walker, C. *Canoe Camping*. Barnes, New York, 1953.

Harrison, D., *Sports Illustrated Guide to Canoeing*. Harper & Row, New York, 1981.

Landry, P. & McNair, M., *Outward Bound Canoeing Handbook*. Lyons & Burford, New York, 1992.

Mead, R., *The Canoer's Bible*. Doubleday, Garden City, NY, 1976.

L. L. Bean, Camping and Equipment Catalog, Freeport, ME, 04033.

The Boundary Waters Catalog, 105 North Central Ave., Ely, MN 55731.

Keel Haulers Outfitters, Catalog, 30940 Lorain Rd. North Olmstead, OH 44070.

Nantahala Outdoor Ctr, Outfitters Catalog, 13077 Hwy 19 W., Bryson City, NC 28713.

Spring Creek Inc. Canoe Accessories Catalog, PO Box 246, Mountain Iron, MN 55768.

Wyoming River Raiders Canoeing & Rafting Catalog, 601 SE Wyoming Blvd Casper, WY 82609.

*Primary Examiner*—Sherman Basinger
*Attorney, Agent, or Firm*—Kevin M. Farrell

[57] ABSTRACT

An apparatus for attaching vertically oriented support legs (10) to the inner walls or sides of a canoe or small carriable boat so that the canoe or boat may be inverted and positioned at an angle high enough above the ground to allow a lone person to step under the carrying yoke (12) or center seat and more easily lift the vessel to a portage position. Support legs (10) may be removed or pivoted out of the way for portaging through brush or over rough terrain. The apparatus also allows a canoe to be stored off the ground in a position which provides emergency shelter or a support frame for draping a tarpaulin and achieving more complete shelter.

2 Claims, 9 Drawing Sheets

POSITIONING AND LIFTING DEVICE FOR A WATERCRAFT

BACKGROUND—FIELD OF INVENTION

This invention relates to canoes and carriable boats, specifically support members or legs which are a new means to invert and situate a canoe or carriable boat above the ground for single-handed transition to a carrying, portaging, or car top loading position, for emergency shelter, or for storage when the watercraft is not in use.

BACKGROUND—DESCRIPTION OF PRIOR ART

Users of canoes or similar small boats frequently encounter situations in which they, alone, must invert and raise a canoe so that it can be portaged on the shoulders for long distances or even moved from place to place at a campground or yard where dragging the watercraft would be damaging. The importance of carrying a canoe high above the ground cannot be dismissed because portaging frequently takes place over rough, rocky terrain, through underbrush, or through areas of limited clearance. Portaging in the true wilderness requires maneuvering over objects and steep inclines, traversing narrow, deep gullies and negotiating narrow passages between rocks or trees.

Only a few manufacturers produce canoes weighing less than 18 kilos (40 pounds). These lightweight canoes are made of prohibitively expensive materials or because of their size and design, are usable only in specialty situations such as flat water or organized racing. Most of the manufacturers who do produce such lightweight canoes, produce a greater number of models made of more conventional materials such as ABS, fiberglass, aluminum, wood, or wood and canvas. In fact the overwhelming majority of accessibly priced canoes most popular for general use and extended wilderness trekking measure from 5 meters (15 feet) to 6 meters (18 feet) and weigh from 27 to 45 kilos (60 to 100 pounds). Dinghies and small wood/canvas boats may weigh from 34 to 55 kilos (75 to 125 pounds). Although a typically active person may be able to carry 27 to 55 kilos when the load is properly mounted or when the load is compact and easy to balance, the act of raising a canoe to the shoulders as well as the act of a lone individual raising or lowering a canoe to or from a vehicle mounted rack requires strength and agility not enjoyed by all. Both acts require good balance, a healthy back, and strong arms even under ideal conditions of a fiat open area where the canoeist might begin portaging. When space is restricted by trees and underbrush, or the typically uneven terrain of the wilderness, lifting a watercraft while balancing its bulk and weight increases the risk of injury to the back, arms, and shoulders.

The prior art relating to the movement, carrying or loading of a canoe or light boat is represented by four categories of devices. Some of these work as intended only under ideal conditions even when combined for use with each other. As will be shown below, such devices are intended to fulfill only limited purposes and do not anticipate the needs or accommodate the difficulties described above.

Wheel mounted devices, dollies or caddies such as U.S. Pat. No. 2,970,846 to Boston, Warren E. (Feb. 7, 1961), U.S. Pat. No. 3,093,386 to Case, Morris A. (Jun. 6, 1968), U.S. Pat. No. 3,445,018 to Reagan, John E. (May 20, 1969) U.S. Pat. No. 4,538,829 to Horowitz, Justin (Sep. 3, 1985) all suffer from the limitation of requiring clear, even terrain.

The track width of the wheels on such devices is too great to pass between small saplings or rock outcroppings or to fit within deeply eroded paths typically encountered by a hiker on foot. When crossing a ravine no wider than the length of a canoe, a wheeled carrier cannot prevent an end of the canoe from dragging on the sides of the ravine. The devices themselves are bulky and must be removed from the canoe and stored when the canoe is used in the water.

Combinations of single or double, bow or stern mounted forks and handles such as U.S. Pat. No. 3,377,095 to Allen, Elmer W. (Apr. 9, 1968), U.S. Pat. No. 4,641,874 to Grenzer, Leslie J. (Feb. 10, 1987), U.S. Pat. No. 4,804,123 to French, Timothy (Feb. 14, 1989), or U.S. Pat. No. 5,127,356 to Schenkenberger, Milton (Jul. 7, 1992) require two people to carry a canoe. Instructional literature by experts frequently describes the awkwardness of two people coordinating their movements over rough terrain when linked together by carrying a canoe. These experts therefore recommend a single carrier even if two people are available. A lone person might use such carrying handles in combination with a wheeled device but would face the limitations described above for those devices. External handle devices also must be removed and stored when the vessel is in use on the water.

Human pack frames or animal mounted pack flames such as U.S. Pat. No. 3,570,730 to Stevens, Charles M. (Mar. 3, 1971) or U.S. Pat. No. 3,734,367 to Jackson, William S. (May 22, 1973) are another category which serve only limited purposes each in their own way. Stevens' pack frame is usable only with a pack animal such as a horse or mule. Jackson's human pack frame requires that an individual perform the difficult task of raising the canoe over his or her head onto the frame which must have already been strapped on to his or her back. The attached pack frame further limits the canoeist's ability to bend and pick up the canoe from the ground.

Modifications or supplements to built-in wooden carrying yokes including shoulder supports, or padded devices such as U.S. Pat. No. 4,016,615 to Main, Glen A. (Apr. 12, 1977), U.S. Pat. No. 4,236,267 to Lewis, Michael. (Dec. 2, 1980),or U.S. Pat. No. 4,768,459 to Cerkvenik, Gary E., (Sep. 6,1988) as in the example of the pack frame above, are not useful for raising or lowering a canoe to or from the carrying position or for any other purpose but the comfort of the carrier once the canoe is in place. The advantage intended by these devices only alleviates the discomfort of the otherwise hard surface of a wooden yoke resting on human skin, bone and muscle tissue. None of these devices provides for relief of the overall body fatigue suffered when carrying a heavy object on the shoulders or back for a lengthy period. In order to effectuate such relief in the form of rest stops, the individual would have to go through the additional strain of safely lowering and raising the canoe to and from the ground.

The conventional means for raising a canoe to the portaging position is to first lean over the gunwales, tip the canoe on one side, and lift the canoe to the hips or thighs using a twisting motion involving the vulnerable spinal joints and muscles. From there one must twist again while using shoulder and arm muscles to press the canoe above the head in order to settle it on the shoulders. Returning the canoe to the ground is little easier because the carrier must use nearly as much effort to avoid suddenly dropping and damaging the canoe. As can be seen, the difficulty of this task is itself a deterrent to taking much needed and more frequent rest stops on a long portage.

No prior art has been found for portable, self contained devices which allow an inverted canoe or boat to be stored above the ground or to quickly provide emergency shelter.

OBJECTS AND ADVANTAGES

Accordingly, several objects and advantages of my invention are to provide a device for inverting and positioning a canoe or boat on one or more support legs high enough above the ground so that the carrier is able to simply crouch and position the shoulders in contact with the portage yoke or center seat. While maintaining balance of the watercraft by holding the gunwales or thwarts, the individual is then able to straighten up, thus disengaging the whole apparatus from the ground. In this way a straight lift is accomplished using the stronger leg muscles. Otherwise the individual must raise the watercraft from the ground using a twisting motion involving the more vulnerable back and arm muscles.

Once the watercraft is stabilized on the shoulders, the individual is able to walk towards another destination. If necessary the support legs are removed or pivoted back to other positions to provide clearance over rough, cluttered terrain or to allow a lone individual to negotiate steep steps, climb over fallen trees or cross narrow, deep ravines. In one such position the individual locks the support legs well within the line of the watercraft gunwales giving the complete freedom of a traditional single-person carry. Another position lines up with a device which loosely engages the support legs on a belt at the individual's hips, freeing the hands for other purposes.

Whenever the individual chooses to stop for a rest or comes to the end of a portage, the legs can be pivoted forward to the vertical and then, by crouching again and resting the apparatus on the ground, the individual can easily step clear. In the resulting position above the ground, the canoe or boat itself provides either temporary shelter or a stable support frame for quickly draping a tarpaulin which provides greater protection when suddenly forced to shore by a storm or downpour.

Given the ease with which a canoeist can achieve the portaging position using this device, one end of a canoe can more easily be set on the rear carrying rack of a truck, van, or wagon-like vehicle while lowering the other end to the ground. From there it is convenient to slide the canoe to a centered position on front and rear racks. The device also allows a canoeist to rest an unsupported end of a canoe on the rear roof rack of a smaller, lower vehicle, engage a set of support legs with the ground, and step out from under the canoe to complete the loading process by sliding the canoe forward onto the front of the roof rack with the support legs folded back. Still further objects and advantages will become apparent from a consideration of the ensuing description and accompanying drawings.

REFERENCE NUMERALS

Figure 1:
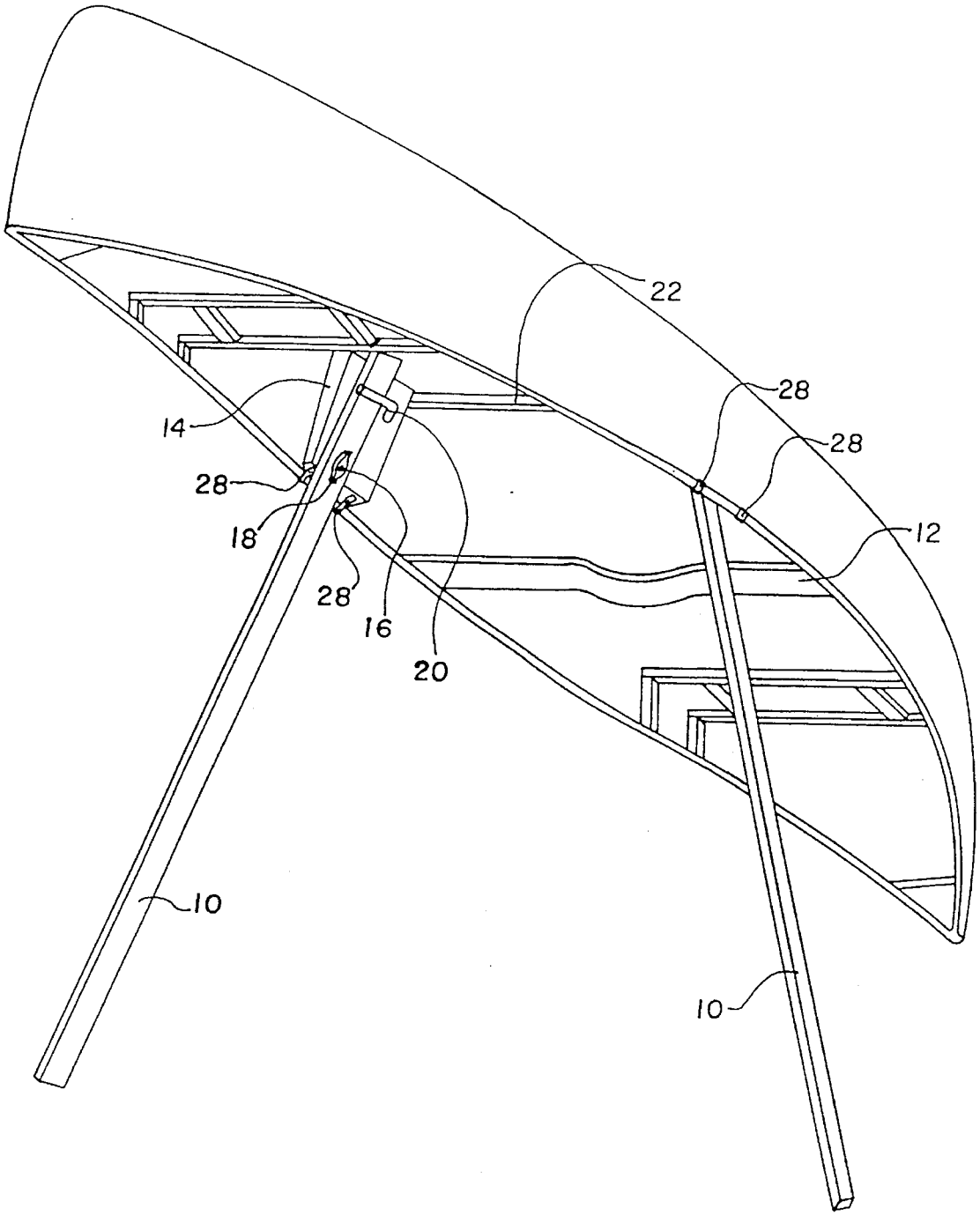
FIG. 1 is a perspective view of a canoe held in the storage position by extended support legs.

10 support leg
12 carrying yoke
14 pivot plate
16 pivot bolt
18 wing-nut
20 retention bracket
22 cross piece
24 adjustment screw
26 strap hinge
28 gunwale clip
30 belt
32 eye
34 hook
36 upper A-bracket
38 lower A-bracket
40 circular band
42 in-line hinge
44 sliding sleeve
46 stop lug
48 spring catch
50 socket
52 cross-member
54 block-mounted strap
56 tightening wedge
58 tether

SUMMARY

An arrangement and combination of struts or support legs of wood, metal tubing, or fiber/plastic tubing and the means by which they attach to the inside walls of a canoe or small boat. The legs are attached at a point about arm's length forward of the carrying yoke or center seat and extend approximately perpendicular to the watercraft viewed from the side, angling outward at the far ends when viewed from the end. The legs may be pivoted back to rest inside the gunwales. The length of the legs is adjustable based on size of the watercraft or user preference. The legs support an inverted canoe at an angle high enough to allow a person to step under the carrying yoke with the knees slightly bent and lift the canoe to a carrying position. Once the canoe is supported on the person's shoulders, the support legs are pivoted back to clear the ground. By pivoting the legs forward the process is reversed to leave the canoe with the two legs and the stern point of the canoe establishing a stable, three point stance. A single support leg will normally suffice for a small boat with a squared off or flat transom. The device is intended to provide an easier means for a lone person to raise or lower the watercraft to or from a portaging position and for loading on a car top carrier. The device is also intended to provide stable, off-ground storage for a canoe. When inverted on the legs the canoe provides emergency shelter or a support frame for draping a tarpaulin which provides more permanent shelter.

PREFERRED EMBODIMENT—DESCRIPTION

The preferred embodiment of the invention is shown in FIG. 1 as two support legs 10 mounted on a canoe at a point just within arm's reach of a person whose neck and shoulders are engaging the center thwart or carrying yoke 12 of the canoe. More specifically this distance would typically be 40 to 60 centimeters (15 to 24 inches) from carrying yoke 12 depending on individual preference.

Support legs 10 in this embodiment are made of elongated wood shafts of sufficient length to hold a canoe high enough above the ground for an individual to step or crouch under carrying yoke 12, and of sufficient thickness and strength to support a canoe in a storage position shown in FIG. 1.

Figure 2:
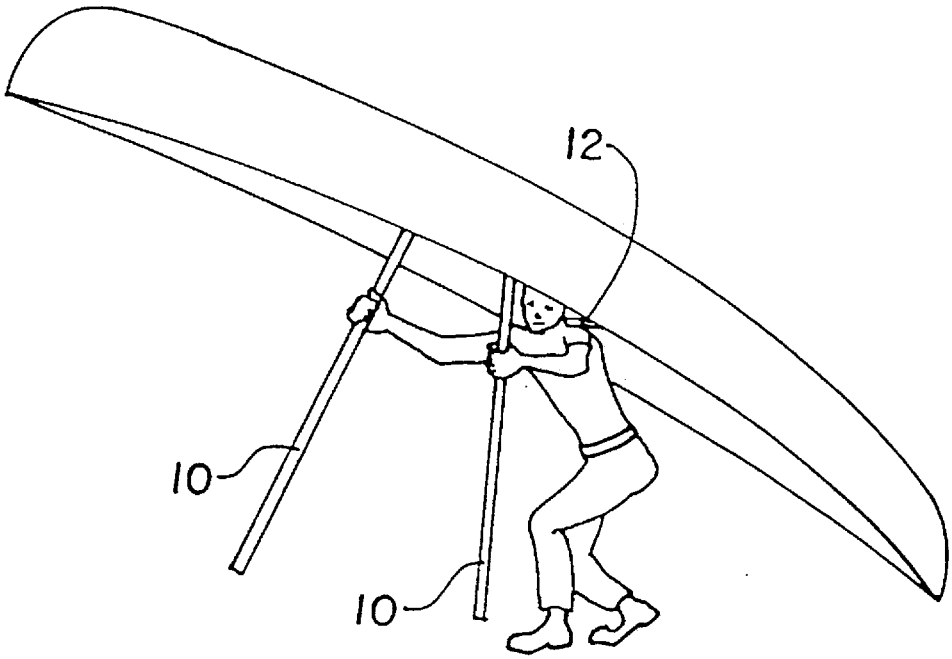
FIG. 2 shows a person positioned under a canoe carrying yoke while beginning to raise the canoe from the ground or at the point of returning the canoe to the storage position.
Figure 2A:
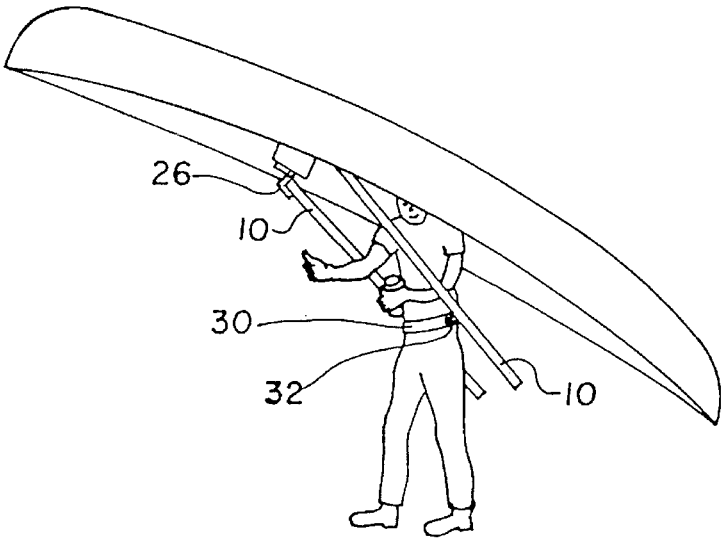
FIG. 2*a* shows a person in full walking position with the support legs pivoted to a second position and engaged with a belt arrangement.
Figure 3:
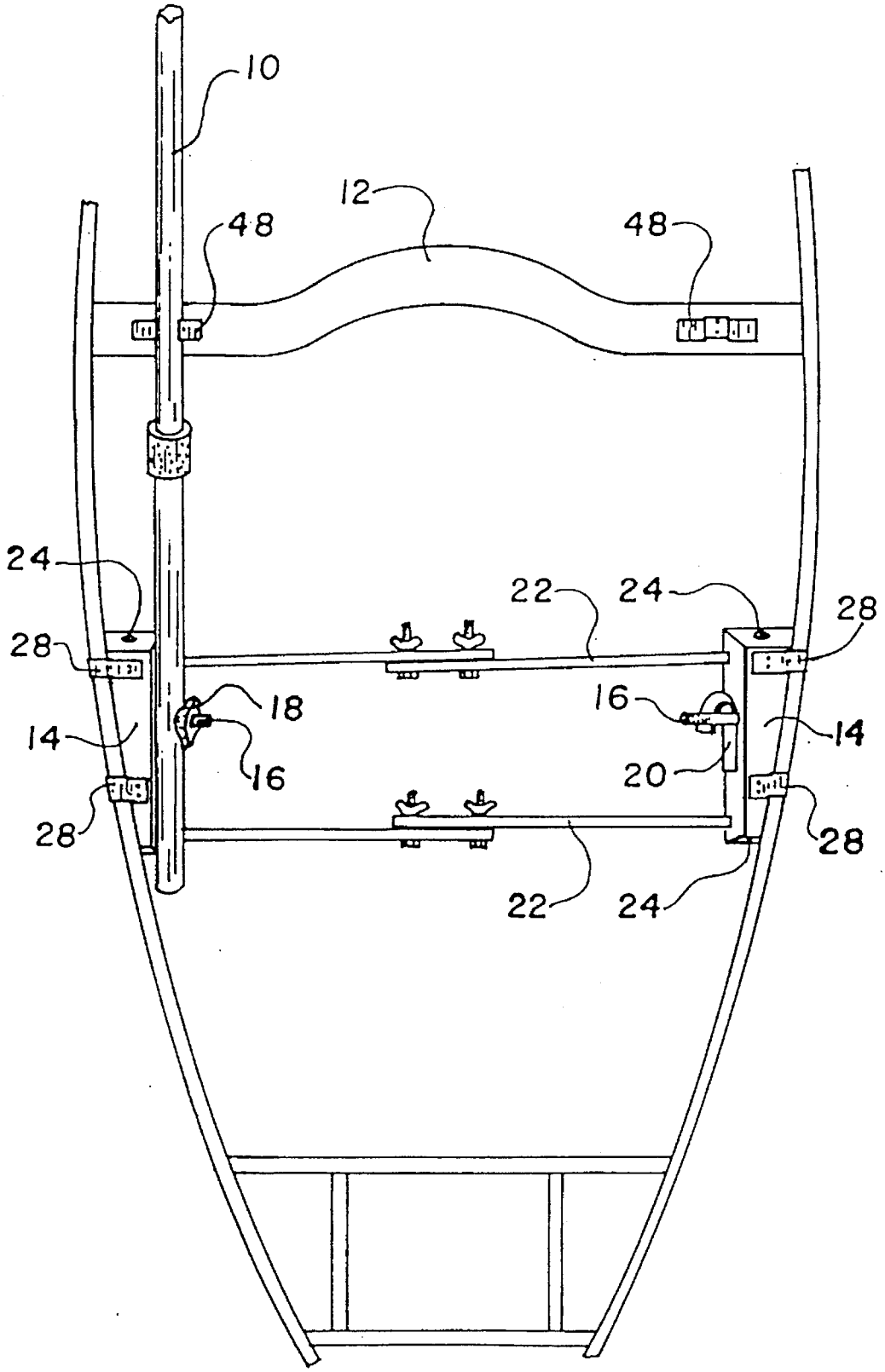
FIG. 3 is a fragmentary top plan view of a canoe showing a kit-mounted leg device, adjustable cross-pieces, pivot plates, and retention brackets. One support leg is shown pivoted back and engaged with a spring catch, the other support leg is left out for clarity.
Figure 4:
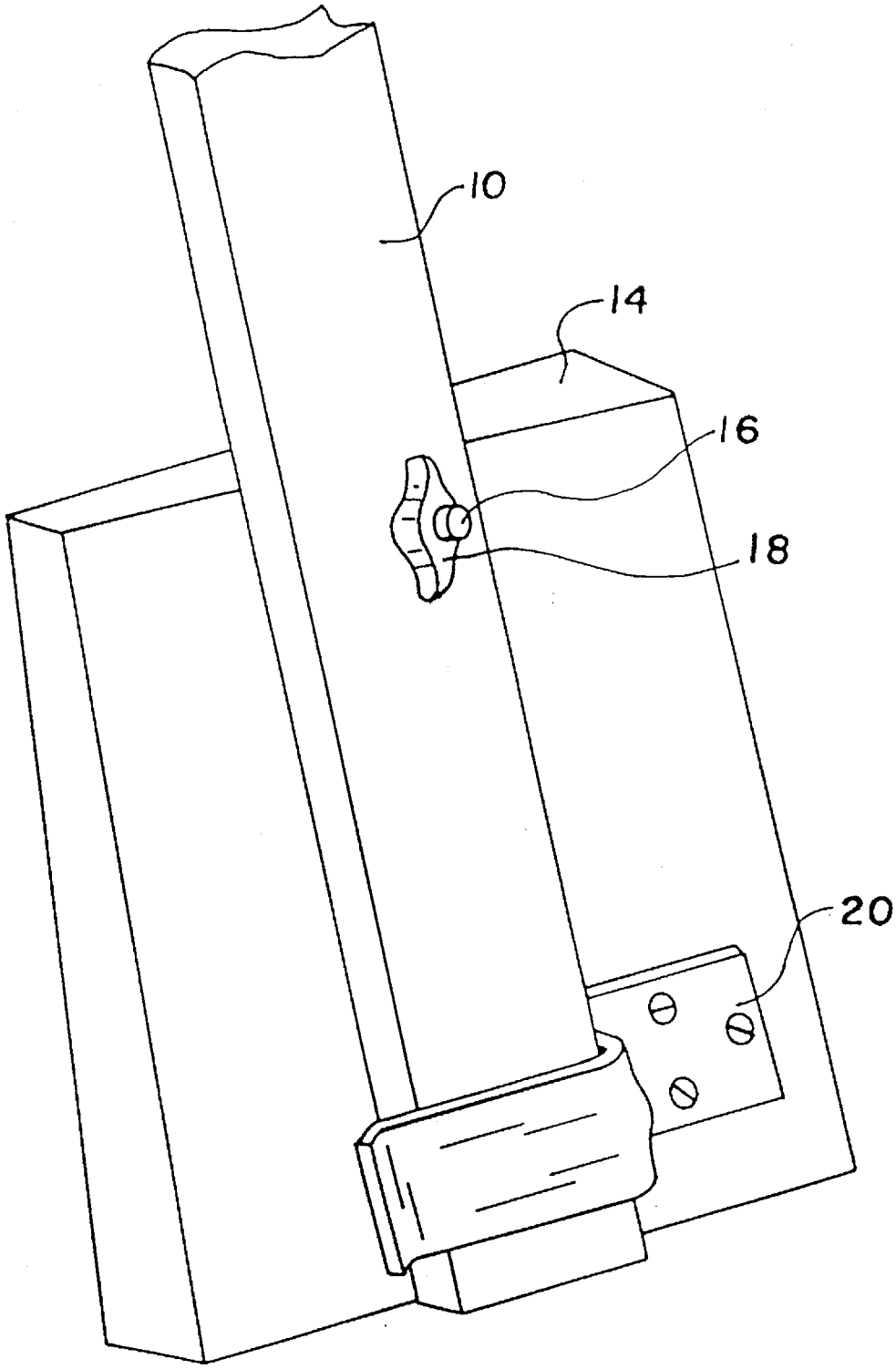
FIG. 4 is a perspective view in detail of one means of shaping a pivot plate, mounting a retention bracket, and locating a pivot bolt to effectuate the desired angles.

As shown in detail in FIG. 4, support legs 10 are attached to a pivot plate 14 by a pivot bolt 16 and turning knob or wing-nut 18. When in the above mentioned storage position, support legs 10 also engage a metal retention bracket 20 which provides lateral stability and which serves as a stop to the forward rotation of support legs 10. Retention bracket 20 as shown in this view is a conventional piece of hardware used for placing a wooden bar across a barn door. As shown in FIGS. 3 and 4, pivot plate 14 features an inwardly facing surface which is angled in such a way that support legs 10 provide a wider base at their distal ends when rotated forward to a roughly vertical position. The angle of pivot plate 14 is further designed to draw support legs 10 inwardly as they are retracted first to a carrying position shown in FIG. 2*a* and then fully retracted as shown in FIG. 3 for normal use of the canoe. Pivot bolt 16 is mounted perpendicular to the inwardly facing surface of pivot plate 14, and is located near enough to the gunwale edge of pivot plate 14 so that support legs 10 lie within and parallel to the gunwales when retracted. FIG. 1 shows an "L" shaped bolt used as retention bracket 20, while in FIG. 3, a "J" shaped metal strap fulfills the same purpose.

Figure 5:
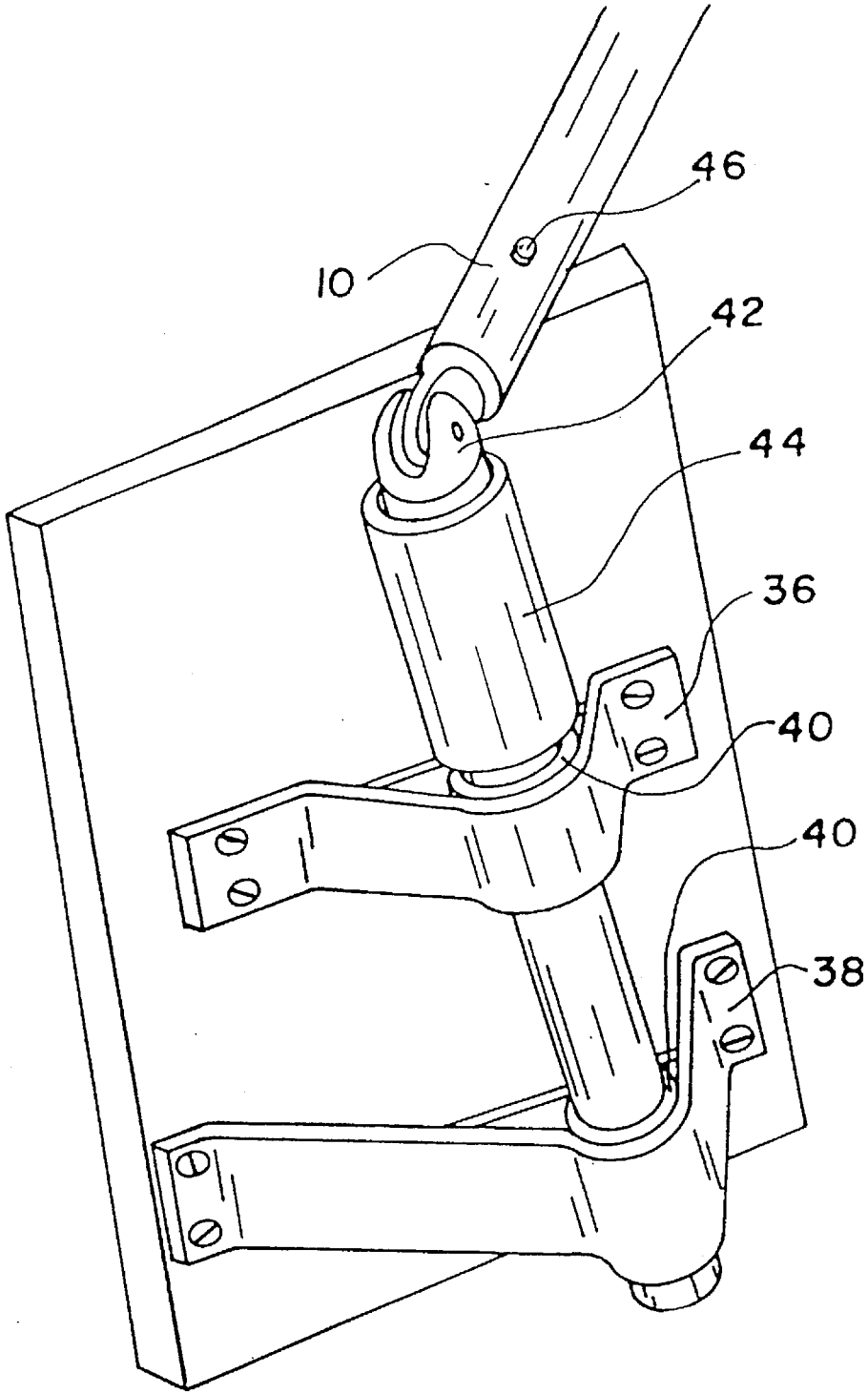
FIG. 5 shows an embodiment of the support device using tubular metal or fiber/plastic support members, an in-line hinge and sleeve device, and "A" brackets.

Pivot plate 14 may be mounted on the inner wall of the canoe in contact with the gunwales as part of the manufacturing process of a new canoe or may be installed permanently in an existing canoe using bolts, screws, adhesives, and backing plates. As shown in FIG. 5, the shape of pivot plate 14 is of greatest importance in these mounting methods in order to achieve the correct angle of the inwardly facing surface, whereas a kit-mounted device as shown in FIG. 3 may employ a flat piece with proper adjustments to serve as pivot plate 14. The kit-mounted device in FIG. 3 is positioned and tightened on cross pieces 22 by means of adjustment screws 24. This assemblage is further held in place by bent metal tabs or gunwale clips 28.

Other methods of clamping pivot plate 14 to the gunwales of the canoe have been used in the development of the present apparatus. Any method suggests the need for at least one cross piece 22 to provide a supplemental hand-hold and to prevent flexing of the sides of the canoe when under load in the storage position of FIG. 1.

Figure 2B:
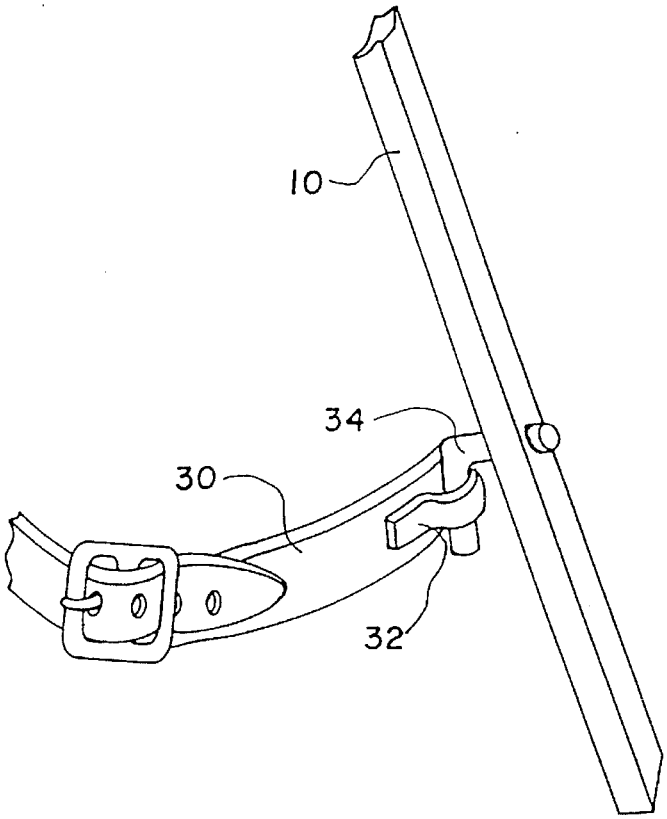
FIG. 2*b* shows details of the belt arrangement which engages support legs during a portage.

A device for engaging support legs 10 when rotated partially back to the carrying position is shown in FIG. 2*b*. This device is a sturdy belt 30 with an attached pair of loops or eyes 32 and an inverted "L" shaped hook 34 attached to support legs 10 at a point in alignment with eyes 32.

PREFERRED EMBODIMENT—OPERATION

The manner in which the support leg device is used for storage of a canoe is demonstrated in FIG. 1. The three point contact with the ground provided by the stern of the canoe and support legs 10 establishes lateral stability. The triangular shape formed by the canoe, the ground, and support legs 10 provides longitudinal stability. As can be seen the canoe makes minimal contact with the ground only at the stern so that something as simple as a block of wood or a flat rock could be used to protect the canoe's wood trim from damp ground during storage.

The inverted storage position of the canoe is achieved starting with the canoe upright on the ground. The canoeist extends support legs 10 to the full vertical position and then, standing facing the point of the of the canoe nearest support legs 10, lifts that end of the canoe to approximately chest height. Then with one hand holding the point where the gunwales meet and the other holding the lower point of the canoe nose near the keel end, the canoeist begins to rotate the canoe on the point of the stern while continuing to lift until the first support leg 10 will clear the ground at approximately 130 to 150 degrees of canoe rotation. Then without lifting further, the rotation is continued to 180 degrees where both support legs 10 are level and may be lowered to the ground.

Figure 1A:
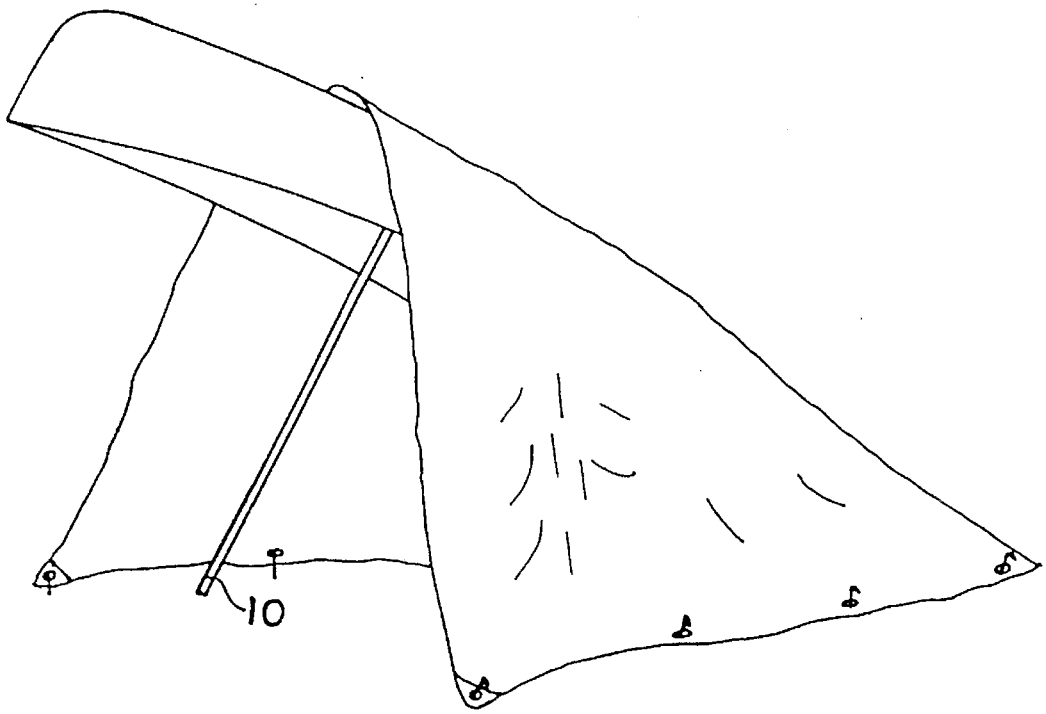
FIG. 1*a* shows the same perspective view as FIG. 1 with a canoe further supporting a tarpaulin.

The views of the apparatus in FIGS. 1 and 2 show how the canoe in the storage position might provide quick shelter from rain. FIG. 1*a* illustrates how a tarpaulin of sufficient size is draped over the keel of the canoe to the ground on both sides and then is anchored along the lower edges with pegs and rope or even weighted down with rocks and logs. The "V" shaped lean-to created by this arrangement may be oriented against the wind as protection from blowing rain to serve as a place to begin unpacking and setting up regular tenting arrangements, or to be used as a regular part of a camp.

FIGS. 2 and 2*a* show the use of the device as a portaging or lifting aid. In FIG. 2 the canoeist has stepped under the canoe with shoulders engaging carrying yoke 12. The canoeist holds the canoe gunwales, cross pieces 22, or support legs 10 to balance the load while beginning to lift the canoe from the ground by straightening the knees and repositioning the feet. In FIG. 2*a* the canoeist is shown walking with the canoe balanced and hands free, having partially retracted support legs 10 and engaged hook 34 with eye 32 which is attached to belt 30. For movement over short distances the use of belt 30, eyes 32 and hooks 34 may be omitted. Similarly when negotiating difficult terrain the canoeist may quickly disengage hooks 34 and fully retract support legs 10 in order to use more appropriate and traditional hand-holds to maneuver and balance the load.

At any time the canoeist is able to quickly extend support legs 10, set the apparatus on the ground, and step clear in order to rest or scout the trail ahead.

OTHER EMBODIMENTS

In one additional embodiment, support legs 10 are elongated tubular shafts constructed of metallic alloys or fiber/plastic. As shown in FIG. 5, support legs 10 are mounted by means of an upper A-bracket 36 and a lower A-bracket 38 each of which embraces a socket or circular band 40 whose inner dimension provides a snug fit with support legs 10 sufficient to hold support legs 10 in place when the canoe is inverted, yet also allowing twisting and removal of support legs 10.

Upper A-bracket 36 and lower A-bracket 38 are mounted either directly to the sidewall of the canoe using screws, adhesives, and backing plates or are mounted on a separate piece which is mounted in a fashion similar to pivot plate 14 in FIG. 4. Upper A-bracket 36 is shorter than lower A-bracket 38 by an amount which allows for the stable outward angle of support legs 10 as demonstrated in FIG. 1. Circular band 40 is mounted in upper upper A-bracket 36 and lower A-bracket 38 at an angle which conforms with the angle desired for support legs 10 when in the extended position.

Support legs 10 are provided with an in-line hinge 42 such as that shown in FIG. 5. A sliding sleeve 44 is positioned over in-line hinge 42 to maintain the alignment of support legs 10 when in the extended position. A pin or stop-lug 46 retains the position of sliding sleeve 44 when support legs 10 are extended. Sliding sleeve 44 is stored on the side of the hinge towards upper A-bracket 34 when not in use. A spring catch 48 is attached to carrying yoke 12 or to a thwart as shown in FIG. 3 to engage support legs 10 when retracted.

The operation of this embodiment is identical to the preferred embodiment except for the method of extending or retracting support legs 10. In this embodiment support legs 10 are held in the extended position by sliding sleeve 44. When the portaging position shown in FIG. 2*a* is achieved, the canoeist slides sliding sleeve 44 away from the hinge in order to pivot support legs 10 rearward while simultaneously rotating them inward to engage hook 34 with belt 30 and eyes 32 as shown in FIG. 2*b*. If the canoeist wishes to fully retract support legs 10 they may be held in place by engaging with spring catch 48 shown in FIG. 3

Figure 1B:
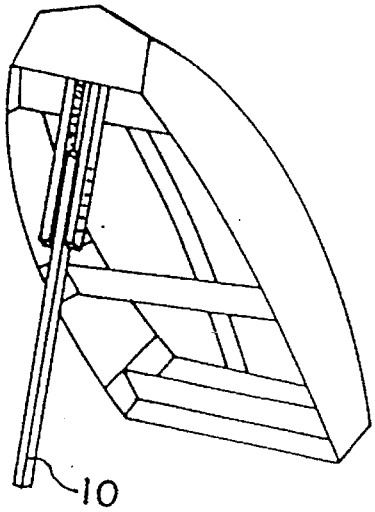
FIG. 1*b* shows another embodiment of the invention comprising a single support leg.

In another embodiment a single support leg 10 is attached at a similar point forward of the center seat or carrying yoke 12 but at the center line of the boat or canoe. As shown in FIG. 1*b* support leg 10 is mounted at the bow of a dinghy to achieve a desirable elevation for a person to lift under the center seat.

In this embodiment the combination of a single support leg 10 with a square-sterned boat or dinghy provides the equivalent of a stable, three-point contact with the ground. This embodiment when used with a canoe is useful primarily to aid in raising the canoe to a portage position. In this embodiment the canoeist is required to maintain a hold on the canoe to balance it while moving from the bow to a position under the portaging yoke. This balance may be further assisted by leaning the raised canoe against a tall object such as a tree.

ADDITIONAL COMBINATIONS

As can be seen from the foregoing there are nearly limitless combinations of hinging and pivoting devices, attachment devices and structural materials which achieve the principles and methods described herein for moving support legs 10 between the extended and retracted positions. Adjustable lengths of cross pieces 22 and of support legs 10 as shown in FIG. 3 may be achieved by conventional methods of sliding grooves, bolts and wing-nuts, threaded extendors, or by any of the currently available snap-stop or telescoping, twist-and-tighten methods conventionally used today for tripod legs, boat-hooks, and extension handles for cleaning tools.

A strap-hinge 26 with locking mechanisms could directly connect support legs 10 with the gunwales of a canoe or to a block mounted on the inner canoe wall as shown in FIG. 2*a*.

Figure 6:
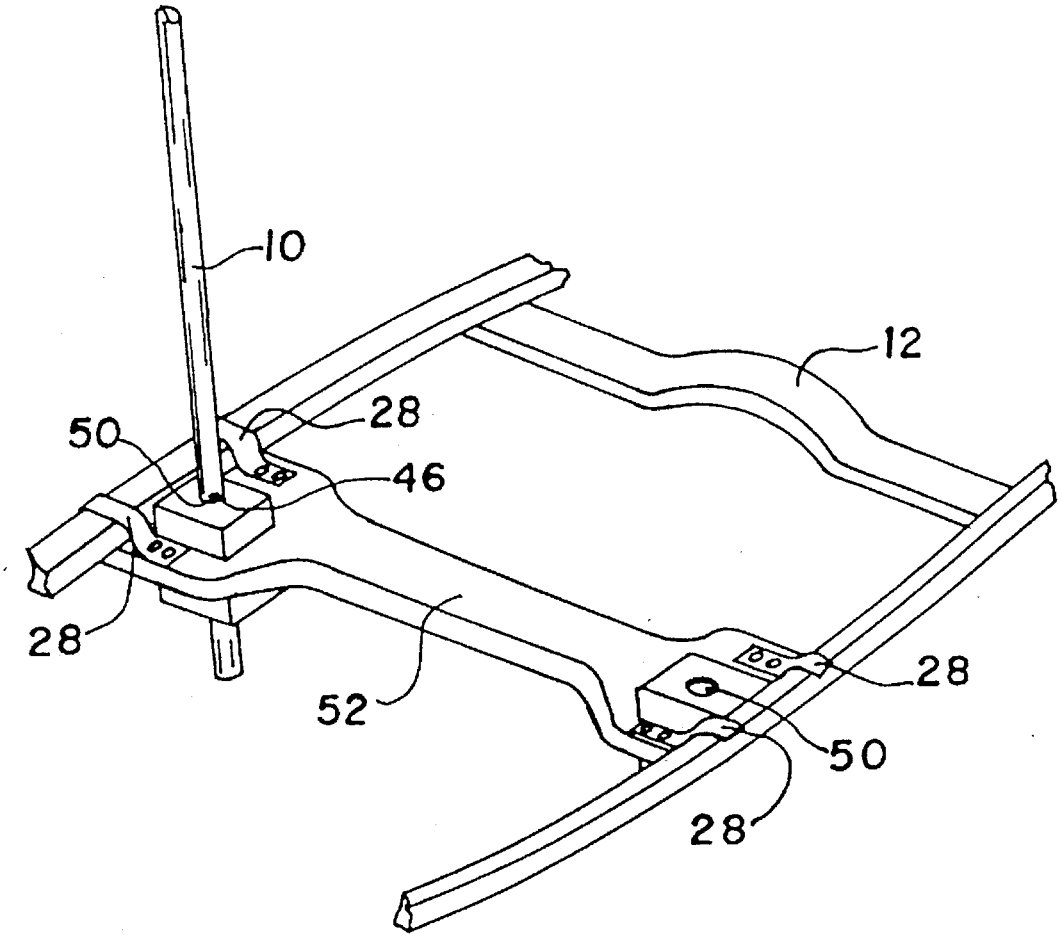
FIG. 6 shows a gunwale mounted cross-member with sockets for retaining support legs.

A block-like socket 50 as shown in FIG. 6 may be constructed as part of, or as a separate piece, be attached to a cross-member 52 which in turn clamps on to the canoe gunwales.

An additional set of support legs 10 may be added at the opposite end of a canoe to provide a level storage position or to provide a support frame for a larger sheltering device when used with a tarpaulin.

When slide-in fittings such as upper A-bracket 36 and lower A-bracket 38 (FIG. 5) or socket 50 (FIG. 6) are utilized in a double set, shorter legs may be substituted so that the inverted canoe will serve as a campsite table or work counter.

Figure 7:
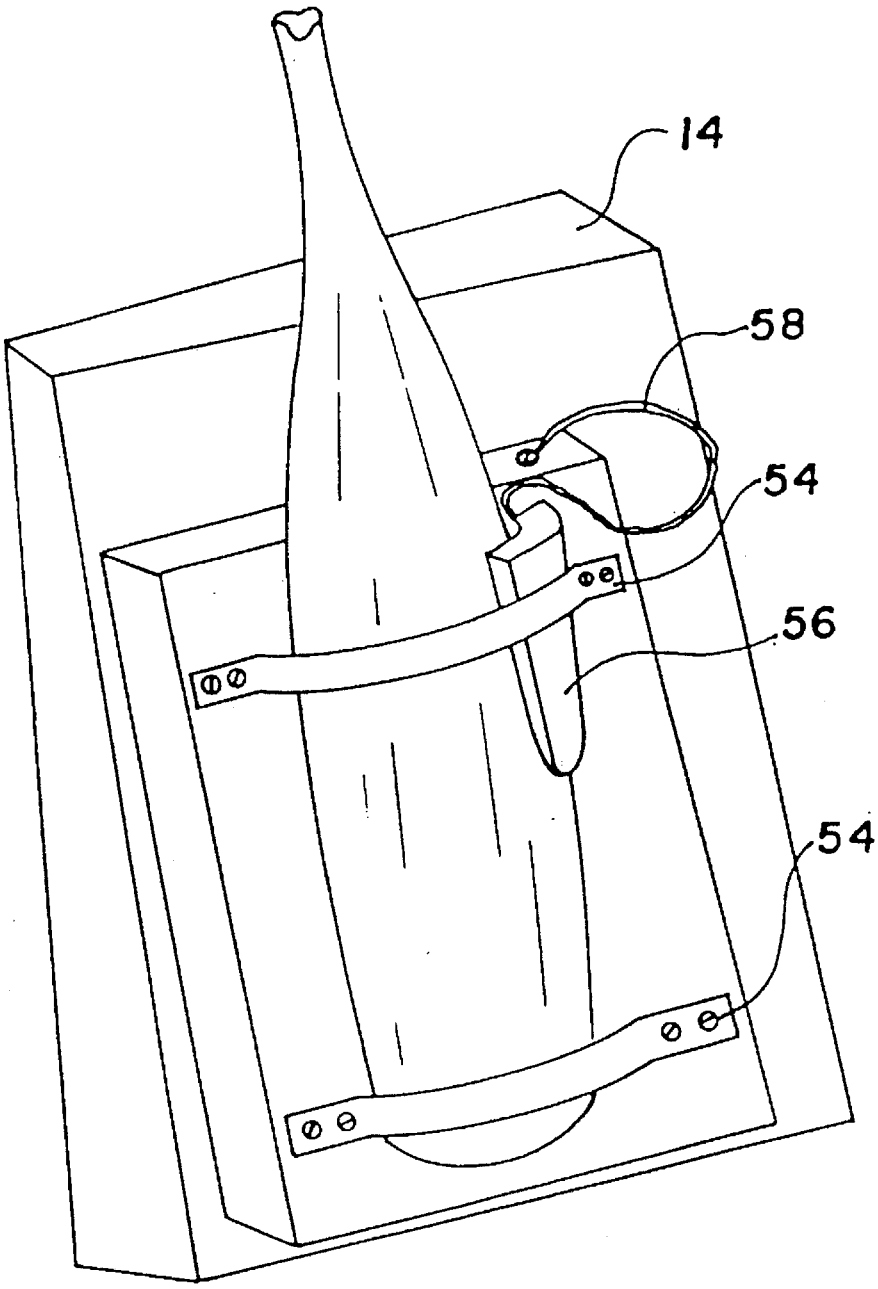
FIG. 7 shows a slot/strap device for retaining a canoe paddle in a position to serve as a support member.

As shown in FIG. 7, a set of slotted devices or block-mounted straps 54 shaped to retain the blade of a canoe paddle may be mounted in a manner similar to pivot plate 14 allowing handle shafts of paddles to support the canoe in place of support legs 10. Where the curvature of a conventional paddle blade requires, a tightening wedge 56 and tether 58 are inserted in upper block-mounted strap 54 to maintain stability.

CONCLUSIONS, RAMIFICATIONS, AND SCOPE

Although the description above contains many specificities, these should not be construed as limiting the scope of the invention but as merely providing illustrations of some of the presently preferred embodiments of this invention. Various other embodiments and ramifications are possible within it's scope. For example, the canoe paddle combination shown in FIG. 7 may be mounted with or without a pivoting device. Thus the scope of the invention should be determined by the appended claims and their legal equivalents, rather than by the examples given.

What is claimed is:

1. A watercraft positioning device comprising at least two support legs for supporting one end of an inverted watercraft above the ground, said support legs being of sufficient length to allow a person to lift a watercraft from a crouched position under a carrying yoke typically located near the center of balance of a watercraft, and self-stabilizing joining means whereby said support legs firmly engage the interior of the watercraft roughly perpendicular to its waterline, said joining means adapted to abut the underside of the gunwales of the watercraft so as to minimize extension of said joining means above the gunwales, said joining means being positioned within arm's reach of the person and further allowing manipulation of each said support leg by one hand of the person while carrying the watercraft in a normal portaging position, said manipulation guiding said support legs to a position within the confines of the watercraft, said joining means being removably fitted into the interior of a watercraft by employment of struts of adjustable length which press said joining means outwardly against opposing interior side-walls of the watercraft and conventional retaining clips which further clamp said joining means to the gunwales.

2. The positioning device of claim 1, further including an apparatus comprising hooks attached to said support legs, said hooks engaging eyes, said eyes being attached to a belt worn by a person to balance a watercraft while in a portaging position.

* * * * *